US008780008B2

(12) United States Patent
Lettkeman et al.

(10) Patent No.: US 8,780,008 B2
(45) Date of Patent: Jul. 15, 2014

(54) REINFORCED MOUNT FOR AN ANTENNA ASSEMBLY

(75) Inventors: David M. Lettkeman, Parker, CO (US); Eric Boize, Phoenix, AZ (US); Jason S. Schmidt, Aurora, CO (US)

(73) Assignee: Dish Network L.L.C., Englewood, CO (US)

( * ) Notice: Subject to any disclaimer, the term of this patent is extended or adjusted under 35 U.S.C. 154(b) by 334 days.

(21) Appl. No.: 13/084,632

(22) Filed: Apr. 12, 2011

(65) Prior Publication Data

US 2011/0187624 A1 Aug. 4, 2011

Related U.S. Application Data

(63) Continuation of application No. 12/483,016, filed on Jun. 11, 2009, now Pat. No. 8,081,139.

(60) Provisional application No. 61/074,352, filed on Jun. 20, 2008.

(51) Int. Cl.
*H01Q 1/12* (2006.01)

(52) U.S. Cl.
USPC ..... 343/878; 343/892

(58) Field of Classification Search
USPC ..... 343/878, 892, 882; 248/285.1
See application file for complete search history.

(56) References Cited

U.S. PATENT DOCUMENTS

| | | | |
|---|---|---|---|
| 3,347,505 | A | 10/1967 | Menser |
| 4,174,821 | A | 11/1979 | Levine |
| 4,203,639 | A | 5/1980 | Mohr et al. |
| 4,500,064 | A | 2/1985 | Calabro |
| 4,698,640 | A | 10/1987 | Redman |
| 5,149,277 | A | 9/1992 | LeMaster |
| 5,306,165 | A | 4/1994 | Nadeau |
| 5,359,820 | A | 11/1994 | McKay |
| 5,617,680 | A | 4/1997 | Beatty |

(Continued)

FOREIGN PATENT DOCUMENTS

| | | | |
|---|---|---|---|
| JP | 2000-049516 | A | 2/2000 |
| JP | 2002-374108 | A | 12/2002 |
| KR | 2000-0047707 | A | 7/2000 |

OTHER PUBLICATIONS

U.S. Appl. No. 12/483,016, filed Jun. 11, 2009, Notice of Allowance mailed Nov. 8, 2011, 8 pages.

(Continued)

*Primary Examiner* — Ahshik Kim
(74) *Attorney, Agent, or Firm* — Kilpatrick Townsend & Stockton LLP

(57) ABSTRACT

An antenna mount including first, second, and third plates is disclosed. A first plate is attached to a second plate to form a plate assembly. When attached, a planar surface of the first plate contacts a surface of the second plate. The second plate may include a stiffening structure. The first plate includes a flange that is oriented parallel to and extending in the same direction as one or more members of the second plate. The flange and the members are positioned to abut opposing surfaces of a mounting base. The third plate includes a planar section and a mounting surface connected to the planar section. The third plate is attached to the plate assembly such that the mounting base is clamped between the third plate and the plate structure. The mounting surface is configured to receive a mounting device of an antenna assembly.

20 Claims, 14 Drawing Sheets

(56) References Cited

U.S. PATENT DOCUMENTS

| | | | | |
|---|---|---|---|---|
| 5,886,673 | A | 3/1999 | Thomas | |
| 5,963,179 | A * | 10/1999 | Chavez | 343/892 |
| 6,180,878 | B1 | 1/2001 | Gretz | |
| 6,262,691 | B1 | 7/2001 | Austin et al. | |
| 6,273,377 | B1 | 8/2001 | Archer | |
| 6,293,035 | B1 | 9/2001 | LaPointe | |
| 6,361,007 | B1 | 3/2002 | Oby et al. | |
| 6,396,459 | B1 | 5/2002 | Pullman | |
| 6,404,405 | B2 | 6/2002 | Wanat | |
| 6,427,348 | B1 | 8/2002 | Webb | |
| 6,445,361 | B2 | 9/2002 | Liu et al. | |
| 6,450,464 | B1 | 9/2002 | Thomas | |
| 6,460,821 | B1 | 10/2002 | Rhudy et al. | |
| 6,727,861 | B2 | 4/2004 | Antoine | |
| 6,734,830 | B1 | 5/2004 | Bickham | |
| 6,766,992 | B1 | 7/2004 | Parker | |
| 6,768,474 | B2 | 7/2004 | Hunt | |
| 6,777,611 | B2 | 8/2004 | Ewald et al. | |
| 6,834,435 | B2 | 12/2004 | Turner | |
| 6,873,304 | B1 | 3/2005 | Malhotra | |
| 7,027,006 | B2 | 4/2006 | Holle | |
| 7,057,575 | B2 | 6/2006 | Malhotra | |
| 7,106,273 | B1 | 9/2006 | Brunson et al. | |
| 7,253,785 | B2 | 8/2007 | Holle | |
| 7,260,920 | B2 | 8/2007 | Weir | |
| 7,456,802 | B1 * | 11/2008 | Bourgeois | 343/878 |
| 7,460,081 | B2 | 12/2008 | Holle | |
| 7,554,036 | B1 | 6/2009 | DeCosta | |
| 7,555,842 | B1 | 7/2009 | Asay | |
| 7,563,131 | B2 | 7/2009 | Sullivan et al. | |
| 7,592,719 | B2 | 9/2009 | Hoopes | |
| D603,342 | S | 11/2009 | DeCosta | |
| 7,648,379 | B2 | 1/2010 | Johnson et al. | |
| 7,683,853 | B2 | 3/2010 | Michaelis | |
| 7,692,094 | B1 | 4/2010 | DeCosta | |
| 7,741,562 | B2 | 6/2010 | Crotinger et al. | |
| D632,545 | S | 2/2011 | DeCosta | |
| 7,918,425 | B2 | 4/2011 | Rathbone et al. | |
| 7,997,546 | B1 | 8/2011 | Andersen et al. | |
| 8,011,628 | B1 | 9/2011 | Suddeth | |
| D647,488 | S | 10/2011 | Decosta | |
| 8,061,051 | B2 | 11/2011 | Allemand | |
| 8,081,139 | B2 | 12/2011 | Schmidt et al. | |
| 8,339,329 | B2 * | 12/2012 | Shen | 343/882 |
| 8,350,153 | B1 | 1/2013 | DeCosta | |
| D678,840 | S | 3/2013 | Decosta | |
| D684,935 | S | 6/2013 | Decosta | |
| 8,462,075 | B2 | 6/2013 | Lettkeman | |
| 8,646,186 | B2 | 2/2014 | Lettkeman et al. | |
| 8,698,692 | B2 | 4/2014 | Lettkeman | |
| 2002/0003504 | A1 | 1/2002 | Yoshida et al. | |
| 2002/0067591 | A1 | 6/2002 | Tajima | |
| 2002/0105476 | A1 * | 8/2002 | Overton | 343/892 |
| 2002/0190172 | A1 | 12/2002 | Oddsen, Jr. | |
| 2003/0086023 | A1 | 5/2003 | Chung et al. | |
| 2003/0229900 | A1 | 12/2003 | Reisman | |
| 2005/0001781 | A1 | 1/2005 | Antoine | |
| 2005/0007241 | A1 | 1/2005 | Kline et al. | |
| 2005/0101183 | A1 | 5/2005 | McCoy et al. | |
| 2005/0101336 | A1 | 5/2005 | Otsuka | |
| 2006/0053447 | A1 | 3/2006 | Krzyzanowski et al. | |
| 2006/0248553 | A1 | 11/2006 | Mikkelson et al. | |
| 2007/0192798 | A1 | 8/2007 | Morgan | |
| 2008/0271331 | A1 | 11/2008 | Allemand | |
| 2009/0052122 | A1 | 2/2009 | Johnson et al. | |
| 2009/0150940 | A1 | 6/2009 | St. John-Larkin | |
| 2009/0165058 | A1 | 6/2009 | Kirchner | |
| 2009/0315804 | A1 | 12/2009 | Schmidt et al. | |
| 2010/0031295 | A1 | 2/2010 | Krzyzanowski et al. | |
| 2010/0177010 | A1 | 7/2010 | Michaelis | |
| 2010/0219183 | A1 | 9/2010 | Azancot et al. | |
| 2011/0032175 | A1 | 2/2011 | Kang | |
| 2011/0083399 | A1 | 4/2011 | Lettkeman et al. | |
| 2011/0205142 | A1 | 8/2011 | Lettkeman | |
| 2011/0259883 | A1 | 10/2011 | DeCosta | |
| 2012/0137530 | A1 | 6/2012 | Yun | |
| 2012/0151785 | A1 | 6/2012 | Lettkeman et al. | |
| 2012/0162044 | A1 | 6/2012 | Lettkeman et al. | |
| 2012/0256809 | A1 | 10/2012 | Lettkeman | |
| 2012/0261529 | A1 | 10/2012 | Lettkeman | |
| 2013/0256480 | A1 | 10/2013 | Lettkeman | |
| 2014/0033496 | A1 | 2/2014 | Lettkeman et al. | |
| 2014/0090260 | A1 | 4/2014 | Lettkeman | |

OTHER PUBLICATIONS

U.S. Appl. No. 13/085,210, filed Apr. 12, 2011 Non-Final Office Action mailed Mar. 27, 2013, 11 pages.

International Search Report and Written Opinion of PCT/US2010/052431, mailed Jun. 10, 2011, 7 pages.

U.S. Appl. No. 13/085,210, filed Apr. 12, 2011, Non-Final Office Action mailed Mar. 27, 2013, 10 pages.

U.S. Appl. No. 12/711,103, filed Feb. 23, 2010, Non-Final Office Action mailed Aug. 1, 2012, 16 pages.

U.S. Appl. No. 12/711,103, filed Feb. 23, 2010, Notice of Allowance mailed Feb. 12, 2013, 13 pages.

U.S. Appl. No. 13/893,304, filed May 13, 2013, Non-Final Office Action mailed Aug. 1, 2013, 10 pages.

U.S. Appl. No. 13/081,364, filed Apr. 6, 2011, Non-Final Office Action mailed Apr. 25, 2013, 12 pages.

U.S. Appl. No. 12/970,749, filed Dec. 16, 2010, Non-Final Office Action mailed Sep. 14, 2012, 16 pages.

U.S. Appl. No. 12/970,749, filed Dec. 16, 2010, Final Office Action mailed Feb. 6, 2013, 15 pages.

U.S. Appl. No. 12/970,749, filed Dec. 16, 2010, Non-Final Office Action mailed May 16, 2013, 13 pages.

U.S. Appl. No. 12/578,367, filed Oct. 13, 2009, Non-Final Office Action mailed Sep. 20, 2011, 21 pages.

U.S. Appl. No. 12/578,367, filed Oct. 13, 2009, Final Office Action mailed Jan. 31, 2012, 11 pages.

U.S. Appl. No. 12/578,367, filed Oct. 13, 2009, Non-Final Office Action mailed May 14, 2012, 12 pages.

U.S. Appl. No. 12/578,367, filed Oct. 13, 2009, Final Office Action mailed Nov. 19, 2012, 10 pages.

Author Unknown, "BMI Measuring Instruments," Accessed on Mar. 13, 2011, 9 pages.

Author Unknown, "Stanley Hand Tools, 77-009—IntelliPoint Plus Level," Accessed Mar. 13, 2011, 1 page.

Author Unknown, "Checkpoint U6 V-Groove Level," Chads Tool Box.com, Accessed Mar. 13, 2011, 6 pages.

Midlite Corporation, "The Power Jumper, HDTV Power Relocation Kit," Nov. 10, 2011, www.Midlite.com, 1 page.

"Powerbridge In-Wall Power Extension System Home," accessed at http://www.powerbridgesolution.com on Sep. 7, 2011, 4 pages.

Legrand, "Flat Screen TV Cord and Cable Power Kit—CMK70," 2011, 1 page.

Author Unknown, Treestand Manual, Locon Treestands, LLC, Waterford, Ohio, known to exist on Oct. 13, 2009, 2 pages. Accessed at: http://www.locontreestands. . .

Home Depot, "PowerBridge Ultra Low Profile In-Wall System", Oct. 18, 2013, 2 pages. Retrieved from: http://www.homedepot.com/catalog/pdfImages/ef/ef60a932-d90e-4a49-aa33-576da0d6feb6.pdf.

Sewell, "DataComm Flat Panel TV Cable Organizer Remodeling Kit with Power Outlet", Inown to exist Nov. 1, 2013, 3 pages. Retrieved from: http://sewelldirect.com/Recessed-Cable-Plate-Remodeling-Kit-with-Electrical-Outlet.asp.

U.S. Appl. No. 13/085,210, filed Apr. 12, 2011 Final Office Action mailed Oct. 25, 2013, 12 pages.

U.S. Appl. No. 12/970,749, filed Dec. 16, 2010, Notice of Allowance mailed Sep. 5, 2013, 9 pages.

International Search Report and Written Opinion of PCT/US2008/086423 mailed on May 11, 2008, 14 pages.

U.S. Appl. No. 13/893,304, filed May 13, 2013, Notice of Allowance mailed Dec. 2, 2013, 23 pages.

U.S. Appl. No. 13/226,929 filed Sep. 7, 2011, Non-Final Office Action mailed Jun. 28, 2013, 31 pages.

U.S. Appl. No. 13/226,929, filed Sep. 7, 2011, Final Office Action mailed Feb. 12, 2014, 30 pages.

U.S. Appl. No. 12/328,082, filed Dec. 4, 2008, Non Final Office

(56) References Cited

OTHER PUBLICATIONS

Action mailed Jan. 14, 2011, 19 pages.
U.S. Appl. No. 12/328,082, filed Dec. 4, 2008, Non Final Office Action mailed Nov. 15, 2011, 18 pages.
U.S. Appl. No. 12/328,082, filed Dec. 4, 2008, Non Final Office Action mailed Apr. 20, 2012, 13 pages.
U.S. Appl. No. 12/328,082, filed Dec. 4, 2008, Final Office Action mailed Oct. 26, 2012, 16 pages.
U.S. Appl. No. 12/328,082, filed Dec. 4, 2008, Non Final Office Action mailed Jul. 8, 2013, 16 pages.
Powerbridge, "3D Power Cable Total Solution Connector Kit Model #TSCK Power Extension Cable Management," retrieved on-line Oct. 18, 2013, 2 pages.
U.S. Appl. No. 12/979,597, filed Dec. 28, 2010, Non-Final Office Action mailed Mar. 28, 2014, 12 pages.
U.S. Appl. No. 13/226,929, filed Sep. 7, 2011, Notice of Allowance mailed Mar. 31, 2014, 16 pages.
U.S. Appl. No. 12/970,749, filed Dec. 16, 2010, Notice of Allowance mailed Apr. 16, 2014, 24 pages.
U.S. Appl. No. 14/098,294, filed Dec. 5, 2013, Non Final Office Action mailed Mar. 13, 2014, 15 pages.

* cited by examiner

REINFORCED MOUNT FOR AN ANTENNA ASSEMBLY

RELATED APPLICATIONS

This application is a continuation-in-part of U.S. Pat. No. 8,081,139, entitled "STRUCTURES AND METHODS FOR MOUNTING AN ANTENNA," filed on Jun. 11, 2009, which is hereby incorporated herein by reference in its entirety. This application claims priority to U.S. provisional application Ser. No. 61/074,352, entitled "STRUCTURES AND METHODS FOR MOUNTING AN ANTENNA", filed Jun. 20, 2008, which is hereby incorporated herein by reference in its entirety.

BACKGROUND

With the introduction of direct-to-home satellite broadcast television systems, such as Direct Broadcast Satellite (DBS) systems, a multitude of television programs, audio channels, and the like previously unknown with terrestrial ("over-the-air") broadcast system's was made accessible to millions of potential subscribers. Direct-to-home satellite broadcast systems are also used for other purposes, such as internet communications. One aspect of such systems that allows such wide accessibility is the use of a small (e.g., less than one meter in diameter) and inexpensive satellite antenna, or "dish". To effectively employ such an antenna, a subscriber merely provides direct line-of-sight between the dish and the satellites of interest, and supplies a stable mounting platform or base to which the antenna is mounted, such as the exterior of the subscriber's home. The latter requirement helps prevent the antenna from becoming misaligned or misdirected as the result of strong winds or other meteorological conditions, which may cause disruption of the satellite signal carrying the programming.

While the limited size of the antenna has resulted in a large potential subscriber base, significant numbers of potential users remain substantially incapable of deploying a satellite antenna due to the environment surrounding their home. For example, multi-dwelling units (MDUs), such as apartment buildings, condominiums, and townhouses, are often associated with strict rules or covenants regarding private use of the common areas and the building exteriors. More specifically, attachment of a satellite dish to the exterior of a building or a railing is generally forbidden, as affixing the dish to these structures typically requires the drilling of holes or other permanent alterations of the structures.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

FIGS. 1-10 and the following description depict specific embodiments to teach those skilled in the art how to make and use the best mode. For the purpose of teaching inventive principles, some conventional aspects have been simplified or omitted. Those skilled in the art will appreciate variations of these embodiments that fall within the scope hereof. Those skilled in the art will also appreciate that the features described below can be combined in various ways to form multiple different embodiments. As a result, the invention is not limited to the specific embodiments described below, but only by the claims and their equivalents.

In addition, directional references employed below, such as "up", "down", "left", "right", "back", "front", "upper", "lower", and so on, are provided to relate various aspects of the structures to each other, and are not intended to limit the embodiments disclosed herein to a particular orientation with respect to their surrounding environment.

Figure 1:
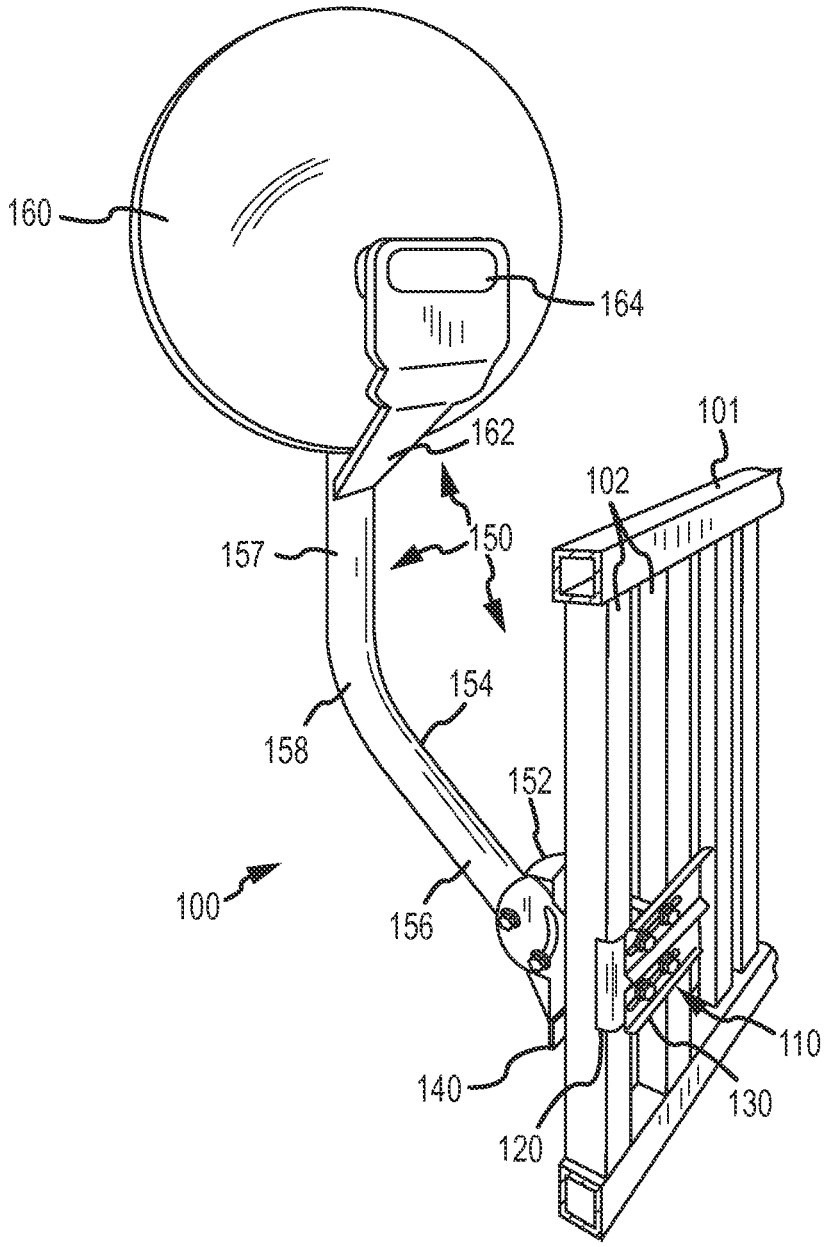
FIG. 1 is a perspective diagram of a system including a dish antenna assembly affixed to a railing antenna mount.

Components discussed herein may be combined to comprise a rail mounted antenna system 100, an example of which is illustrated in FIG. 1. In the exemplary embodiment of FIG. 1, the system 100 may include the antenna mount 110, which includes a first plate 120 attached to a second plate 130—forming a plate assembly—attached to a third plate 140 to clamp a mounting base 102 therebetween (e.g., railing support posts 102 of rail 101, as depicted in the specific example of FIG. 1). The details, features, and elements of these components of the antenna mount 110 are discussed in more detail below. The antenna mount 110 is coupled to an antenna assembly 150. Specifically, the antenna mount 110 may be coupled to a foot section 152 (i.e., a mounting device) of the antenna assembly 150, as described below. An antenna mast 154 is coupled to the foot section 152. In at least one embodiment, the antenna mast 154 may have a first portion 156 which is connected to the foot section 152, and a second portion 157 which is connected to the first portion 156 via a curved connecting portion 158, such that the second portion 157 of the antenna mast 154 may be disposed at an angle to the first portion 156. In at least one embodiment, the second portion 157 may be vertical and/or parallel to railing support posts 102 to which the antenna mount 110 is mounted.

In the specific example of FIG. 1, the second portion 157 of antenna mast 154 of the antenna assembly 150 is coupled to a reflector 160. In at least one embodiment, the antenna mast 154 may be coupled to the reflector 160 with a coupling device (obscured from view in FIG. 1), which may permit a person to adjust the azimuth, elevation, and/or the skew of the reflector in order to properly align the reflector with a signal source, such as a satellite or signal tower. The reflector 160 and/or mast 154 may be further connected to a feedhorn arm 162, which is connected to a signal receiving device 164 that receives communication signals that are reflected by the reflector 160. In at least one embodiment, antenna assembly 150 may comprise a satellite dish antenna. In other embodiments antenna assembly 150 may comprise a dish-type antenna for receiving over-the-air radio-frequency and/or microwave signals, for example, a dish antenna for receiving broadband wireless signals, cellular signals, television signals, etc.

Figure 2:
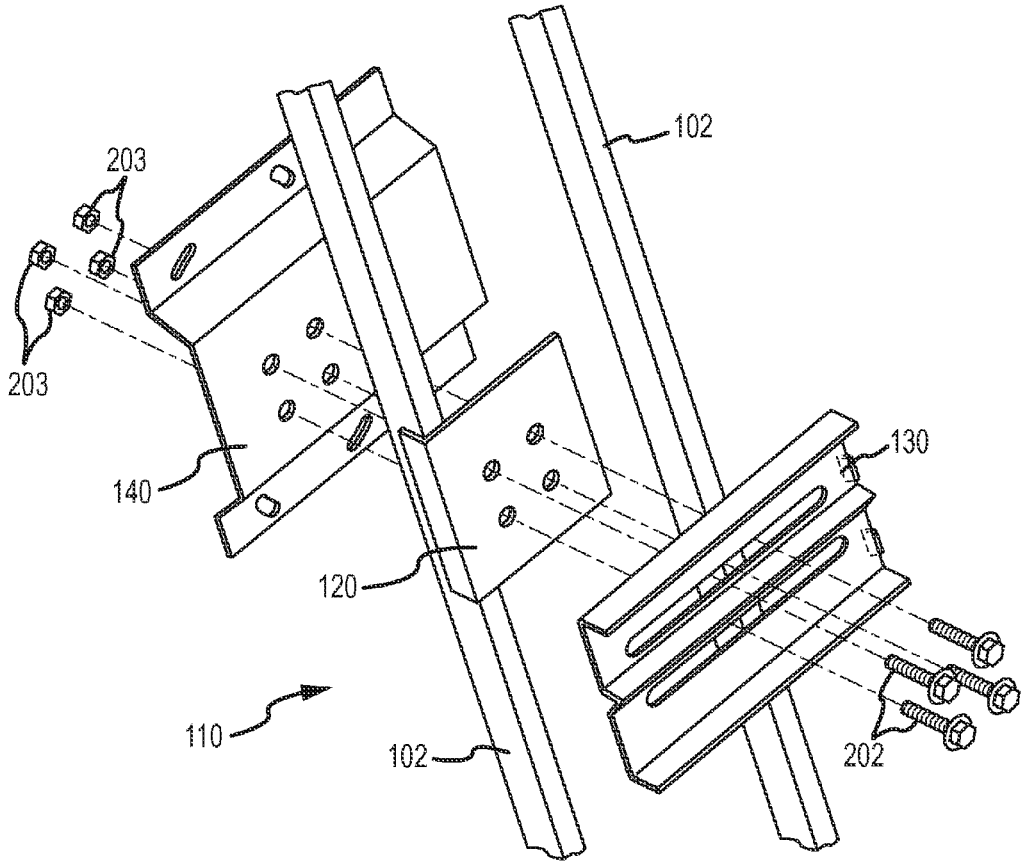
FIG. 2 is an exploded perspective view of an antenna mount according to one embodiment.

FIG. 2 depicts an exploded view of an embodiment of the various plates of an antenna mount 110 of FIG. 1. Antenna mount 110 includes a first plate 120, a second plate 130, and third plate 140. First plate 120 may be secured to second plate 130 with one or more attachment devices 202, thereby forming a plate assembly. In at least one embodiment, attachment devices comprise bolts. The attachment devices may extend through the second plate 130 and the first plate 120 to attach the plate assembly to the third plate 140 in order to clamp a mounting base—in this example, two support posts 102 of a rail—between the plate assembly and the third plate 140. The attachment devices 202 may be of various lengths. In some embodiments, a length of the attachment devices may be dictated by the thicknesses and/or configuration of the plates that comprise the antenna mount 110 and a thickness of the mounting base (e.g., support posts 102) to be clamped therebetween. For example, attachment devices of greater lengths may be usable to clamp thicker support posts or other mounting bases of greater thickness between the plates of the antenna mount 110. In at least one embodiment attachment devices 202 may further comprise one or more nuts 203. The various features and elements of the components depicted in FIG. 2, and various different embodiments and configurations thereof, are described in more detail below.

Figure 3:
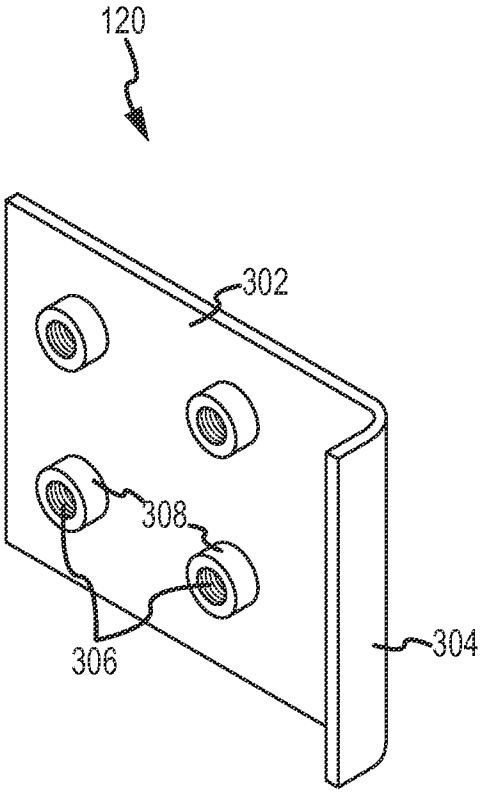
FIG. 3 is a perspective view of a first plate of the antenna mount of FIG. 2 according to one embodiment.

FIG. 3 depicts one component of an antenna mount according to one embodiment: a first plate 120 including a substantially planar section 302 having a planar surface and a flange 304. In the specific embodiment of FIG. 1, the flange 304 is formed at an end of the planar section 302, although various locations for the flange 304 may be possible in other examples. Additionally, in the example of FIG. 3, flange 304 extends the entire edge of the plate 120. However, in other embodiments, flange may constitute less than the entire edge of the plate, or the plate may comprise one or more members (e.g., similar to members 404B plate 130B, discussed below) disposed similarly to flange 304. The first plate 120 also defines a plurality of openings, e.g., holes 306, through which may extend bolts, screws, or other fasteners. In one implementation, the holes 306 are threaded to accept an appropriately sized bolt for securely attaching the first plate 120 to other structures, as is described in greater detail elsewhere herein. In another implementation, a threaded structure 308, such as a nut, may be integrated with the planar section 302 and aligned with each of the holes 306. Further, while four holes 306 are shown in FIG. 3, other numbers of holes may be utilized in other embodiments.

In one embodiment, the first plate 120, as well as the remaining plates described hereinafter, may be fabricated from sheet metal or another material of sufficient strength to resist flexing and deformation, especially under inclement weather conditions, such as strong winds, heavy rains, and the like. Other materials, such as plastic, fiberglass, or composite materials, may be employed in other implementations. Also, the first plate 120, as well as others described below, may be approximately one-eighth to one-sixteen inch thickness, although any other thickness may be utilized so that the plate 120 is fashioned to withstand the forces exerted by the weight and positioning of an attached antenna and the gravitational and external forces expected in the environment in which the antenna will be mounted.

Figure 4A:
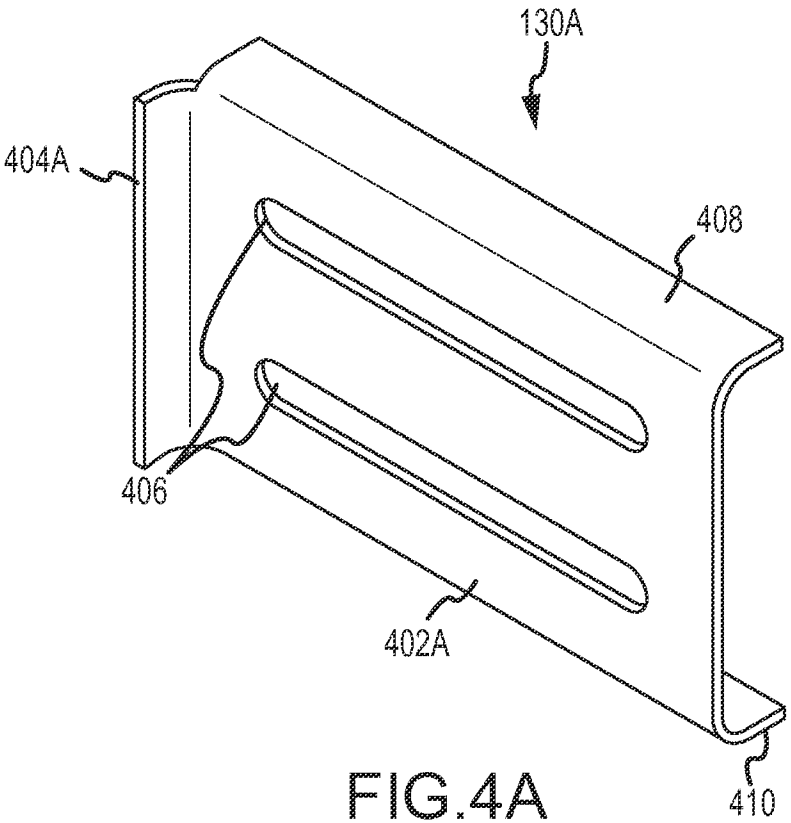
FIG. 4A is a perspective view of a second plate of the antenna mount of FIG. 2 according to one embodiment.
Figure 4B:
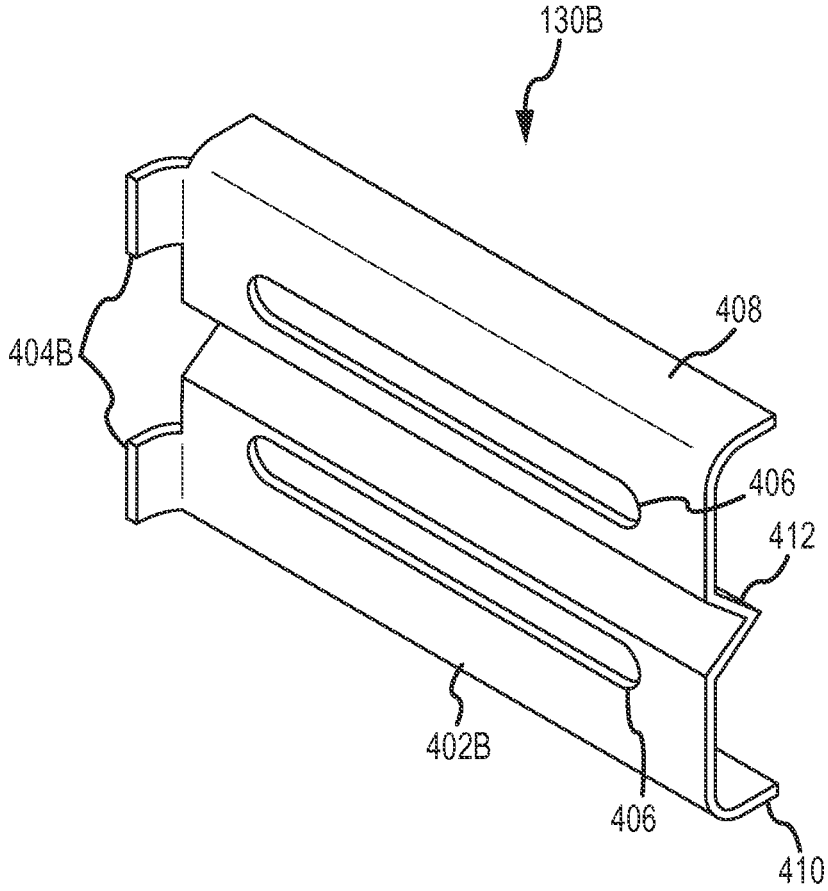
FIG. 4B is a perspective view of a reinforced second plate of an antenna mount according to one embodiment.

FIGS. 4A and 4B illustrate different embodiments of a second component: a second plate 130 depicted in FIG. 1. As used herein "second plate 130" may refer to any implementation of second plate 130, whether it be the example second plate 130A depicted in FIG. 4A, the example second plate 130B depicted in FIG. 48, or another implementation.

Turning to the second plate 130A depicted in FIG. 4A, the plate 130A includes a planar section 402A and a flange 404A. As with the first plate 120, the flange 404A extends from one end of the planar section 402A, although other locations and flange sizes are also possible. Additionally, the planar section 402A defines a pair of slots 406 transverse to the flange 404A for adjustment purposes, as described more fully below.

In the particular example of FIG. 4A, an upper extension 408 and a lower extension 410 may extend from opposing edges of the planar section 204 in an opposing direction to that of the flange 404A. These extensions 408, 410 may serve to maintain the structural integrity of the planar section 402A. The extensions 408, 410 may also be utilized as a registration surface for proper alignment of the second plate 130A with another surface. In other examples, the extensions 408, 410 may be eliminated from the second plate 130A.

FIG. 4B illustrates another configuration of a second plate, plate 130B, which is a component of at least one embodiment of an antenna mount. In various embodiments, second plate 130B may have some features that correspond to the second plate 130A of FIG. 4A. Second plate 130B includes a surface 402B, similar to planar section 402A of FIG. 2. Surface 402B defines a pair of elongated openings (i.e., slots) 406, similar to slots 406 of FIG. 4A, for adjustment purposes. Second plate 130B further includes members 404B extending from one end of surface 402B, which are disposed at a transverse angle to surface 402B. Members 404B may provide the same or similar purposes for plate 130B that flange 404A provides for plate 130A, which purposes are described elsewhere herein.

In the embodiment of a second plate of FIG. 4B, an upper extension 408 and a lower extension 410 may extend from opposing edges of surface 402B in an opposing direction from members 404B. These extensions 408, 410 may serve to maintain the structural integrity of the surface 402B. The extensions 408, 410 may also be utilized as a registration surface for proper alignment of the second plate 130B with another surface. In other examples, the extensions 408, 410 may be eliminated from the second plate 130B.

Second plate 130B may additionally include one or more stiffeners, depicted in this example as a corrugation 412 that is disposed longitudinally in the surface 402B. It is to be understood that multiple corrugations or other stiffeners, similar or dissimilar to the depicted corrugation 412, may be used to provide stiffness and/or support to the antenna mount and one or more of the plates thereof. In some embodiments, corrugation 412 may be defined by the surface 402B. In the example of FIG. 4B, the corrugation 412 comprises an angular extrusion from the plane of the surface 402B, which extrudes from the surface 402B in an opposing direction from members 404B. The corrugation 412 may function as a stiffener to further maintain the structural integrity of the second plate 130B, given that torque, torsion and/or other forces from an attached antenna may be exerted on the plate 130B and other components attached thereto.

Figure 5:
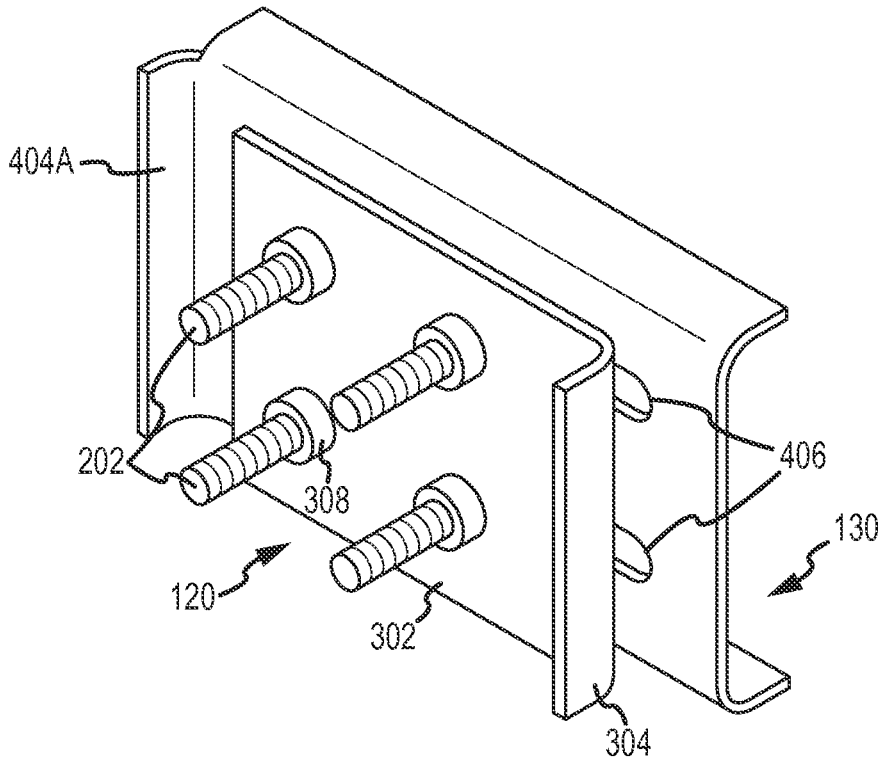
FIG. 5 is a perspective view of the first plate of FIG. 3 and the second plate of FIG. 4A loosely attached together according to one embodiment.

FIG. 5 provides a perspective view of the first plate 120 and the second plate 130 aligned so that bolts 202 or other attachment devices may be inserted through the slots 406 of the second plate 130 and threaded through the threaded structures 308 of the first plate 120. In another embodiment, the holes 306 of the first plate 120 may themselves be threaded for engagement with the bolts 202. In another example, threaded nuts separate from the first plate 120, including locking nuts, serrated hex head nuts, nuts integrated with lock washers, and the like, may be threaded onto the bolts 202 in order to affix the first plate 120 to the second plate 130. The bolts 202 may first be threaded through another component, such as a washer or lock washer (not shown in FIG. 5), before being inserted through its corresponding slot 406 of the second plate 130 and associated hole 306 of the first plate 120. Such a component may provide a stable surface against which the head of the bolt 202 may exert a tightening force onto the second plate 130 in order to attach it securely to first plate 120.

In FIG. 5, the first plate 120 and the second plate 130 are connected via the bolts 202, but are yet to be rigidly attached together. This arrangement allows the first plate 120 to translate back and forth along the direction of the slots 406 of the second plate 130, thus allowing the distance between the flange 304 of the first plate 120 and the flange 404A of the second plate 130A—or members 404B of the second plate 130B in an embodiment with second plate 130B—to be adjusted.

Figure 6A:
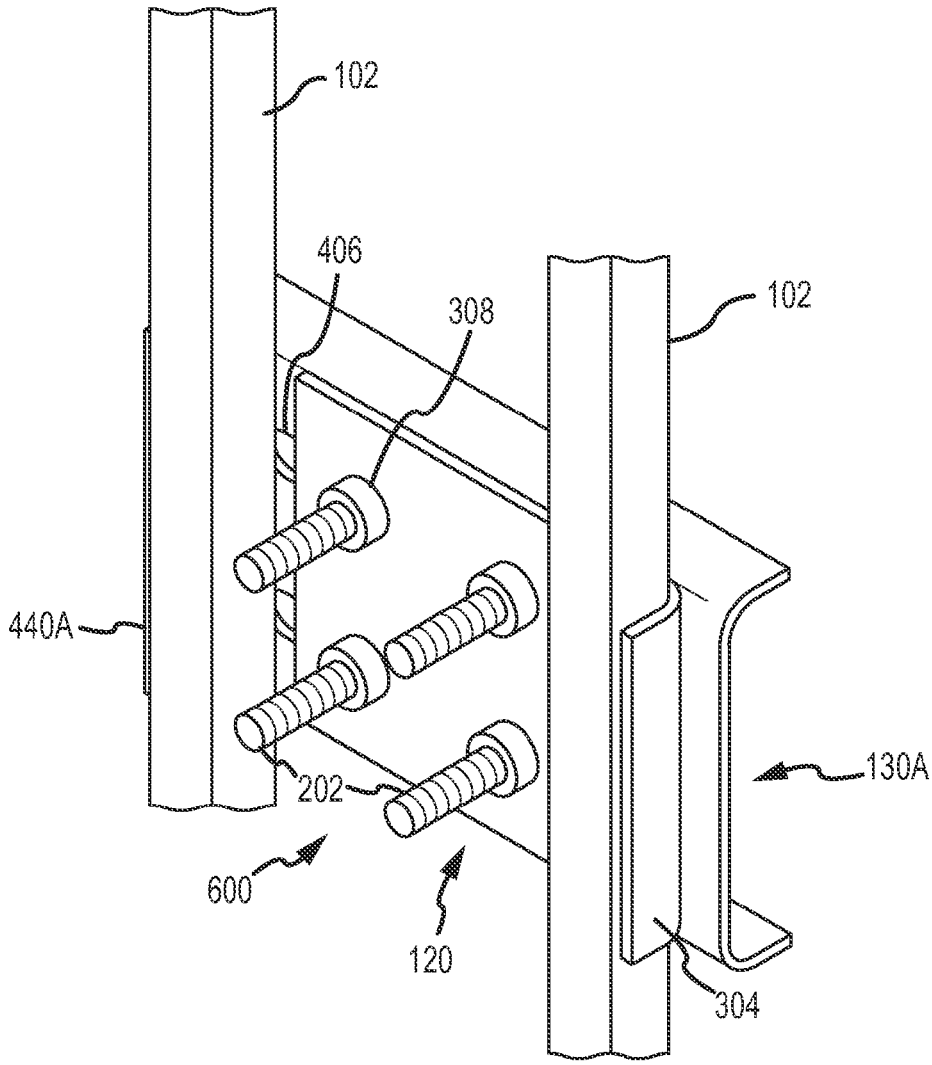
FIG. 6A is a perspective view of the first plate of FIG. 3 and the second plate of FIG. 5A securely affixed together to form a plate structure or assembly according to an embodiment, wherein the plate assembly is adjusted to span a pair of railing supports.

FIG. 6A provides a perspective view of the first plate 120 and the second plate 130A, in which the distance between the flange 304 of the first plate 120 and the flange 404A of the second plate 130A has been adjusted to contact or abut, and possibly grip, oppositely-facing surfaces of two adjacent support posts 102 of a railing or banister.

Figure 6B:
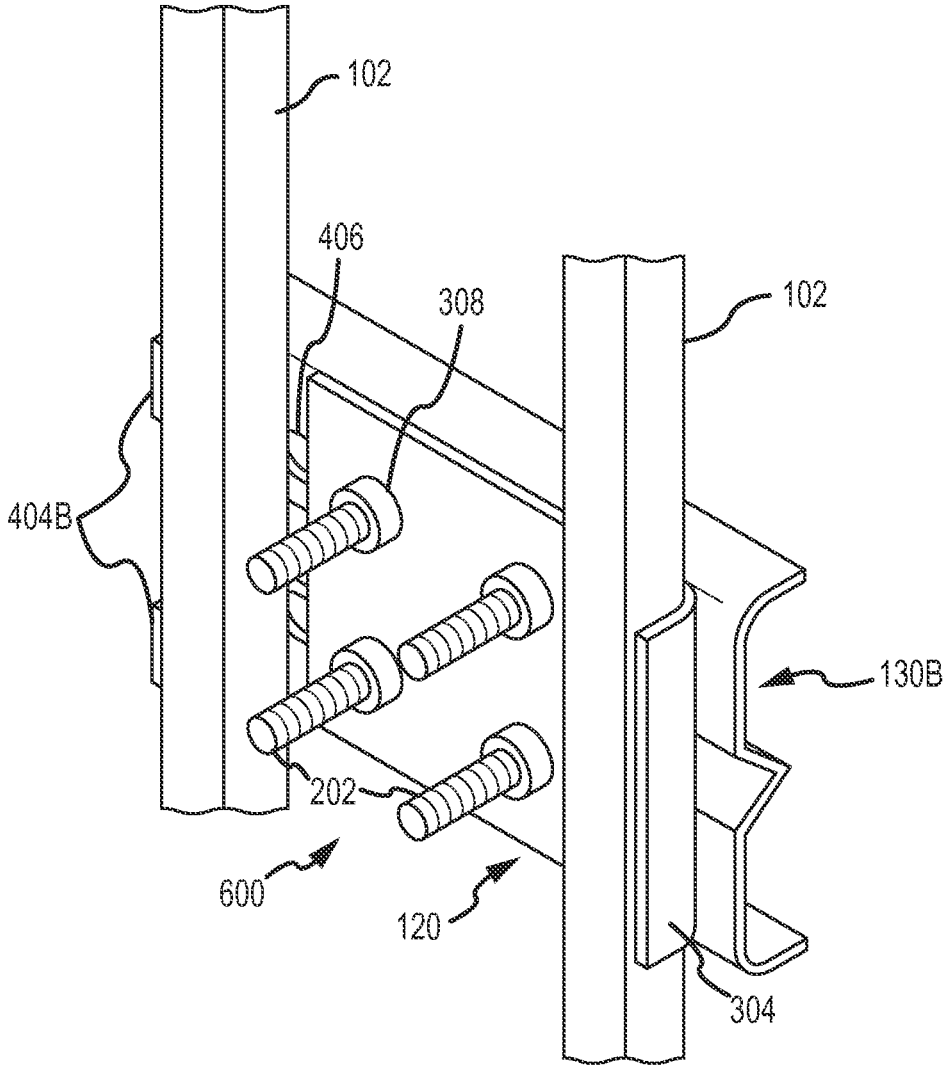
FIG. 6B is a perspective view of the first plate of FIG. 3 and the reinforced second plate of FIG. 5B securely affixed together to form a plate structure of assembly according to an embodiment, wherein the plate assembly is adjusted to span a pair of railing supports.

FIG. 6B provides a similar view of the first plate 120 and the second plate 130B, in which the distance between the flange 304 of the first plate 120 and the members 404B of the second plate 130B has been adjusted to contact or abut, and possibly grip, oppositely-facing surfaces of two adjacent support posts 102 of a railing or banister.

In some embodiments, support posts 102 may be metal. In other examples, the support posts 102 may be manufactured from wood, plastic, fiberglass, or another material. Such a railing may be found at an apartment, condominium, or other multi-dwelling unit. Other environments may provide structures similar to the support posts 102.

Once this adjustment has been made, such that flange 304 of first plate 120 and flange 404A or members 404B of second plate 130 (A or B) abut the support posts 102, the bolts 202 may be tightened while the first plate 120 and the second plate 130 are held stationary against the posts 102 to rigidly attach and secure the first plate 120 to the second plate 130, i.e., to form a plate structure or plate assembly 600 as depicted in FIGS. 6A and 6B. In one example, the flange 304 and flange 404A or members 404B may exert enough force on the adjacent support posts 102 to at least temporarily maintain the position of the plate assembly 600 against the posts 102.

The first plate 120 and the second plate 130 may be sized and configured to be adapted to a number of different mounting bases. More specifically, features of the first plate 120 and the second plate 130 that may be modified to accommodate different environments including the number and relative spacing of the holes 306 and slots 406, and the length of the plates 120 and/or 130. For example, if longer spans between adjacent support posts 102 are anticipated, one or both of the first plate 120 and the second plate 130 may each be fashioned to be long enough so that the resulting plate assembly 600 spans at least two adjacent posts 102. Also, the length of the slots 406 may be altered so that the overall length of the plate assembly 600 may be adjusted to fit a predetermined range of distances between posts 102.

In other arrangements, other objects or surfaces may serve as the mounting base to which the first plate 120 and the second plate 130 attach. For example, railing support posts of varying size and width may be utilized as the mounting base. Other vertically- or horizontally-oriented structures located sufficiently close to each other may present another possibility. In other examples, any stable surface or object capable of being placed in contact with the flanges 304 and 404A—or flange 304 and members 404B—so that the plate assembly 600 may span the object while allowing the first plate 120 and the second plate 130 to be firmly attached to each other may also be used.

While FIGS. 1-6B specifically depict four bolts 202 engaged with four holes 306 of the first plate 120 and two horizontal slots 406 of the second plate 130, varying numbers of bolts 202, holes 306, and slots 406 may be employed in other implementations while remaining with the scope. Also, while two bolts 202 and holes 306 are associated with each slot 406, greater or fewer bolts 202 and holes 306 may be used in conjunction with each slot 406 of the second plate 130. In still other embodiments, other types of fasteners, such as screws, clips, clamps, and the like, that are capable of rigidly attaching the first plate 120 and the second plate 130 together may be used in addition to, or as a replacement for, any or all of the bolts 202, holes 306, and slots 406 employed in the Figures and described herein.

Figure 7A:
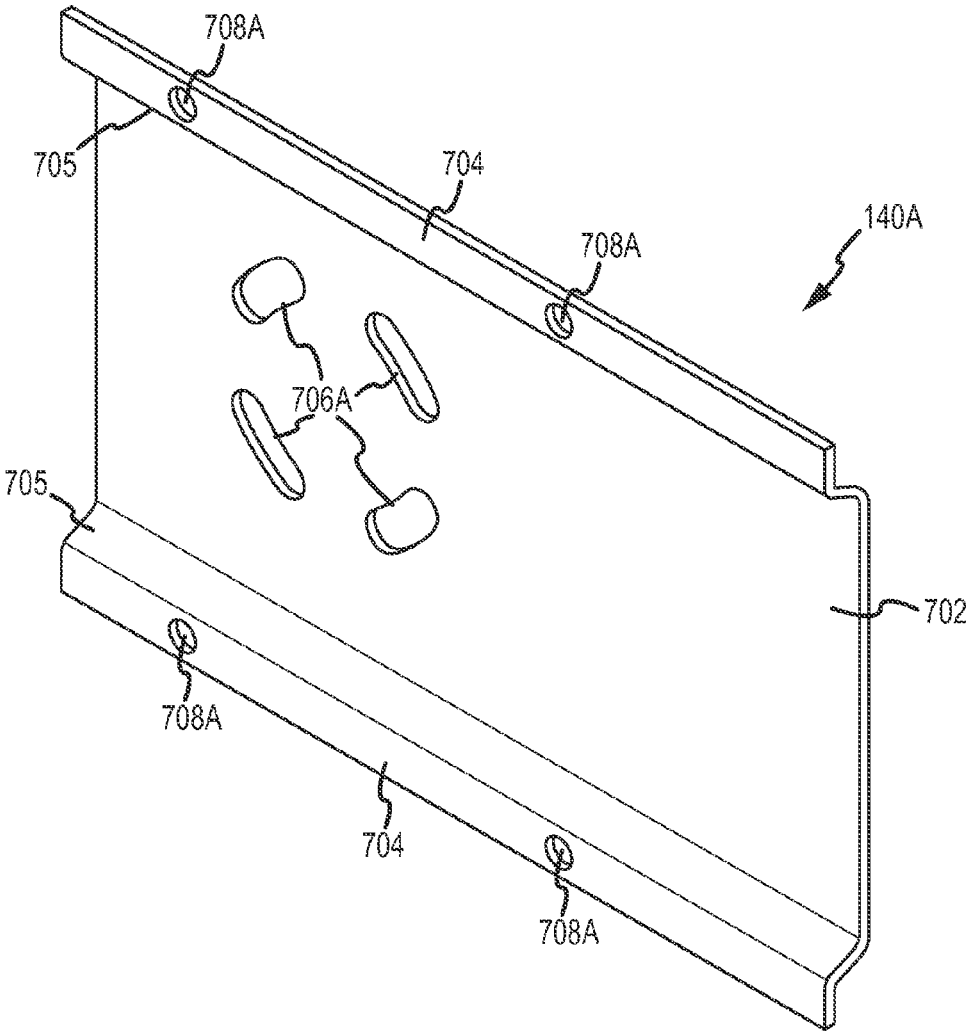
FIG. 7A is a perspective view of a first configuration of a third plate of an antenna mount according to an embodiment.
Figure 7B:
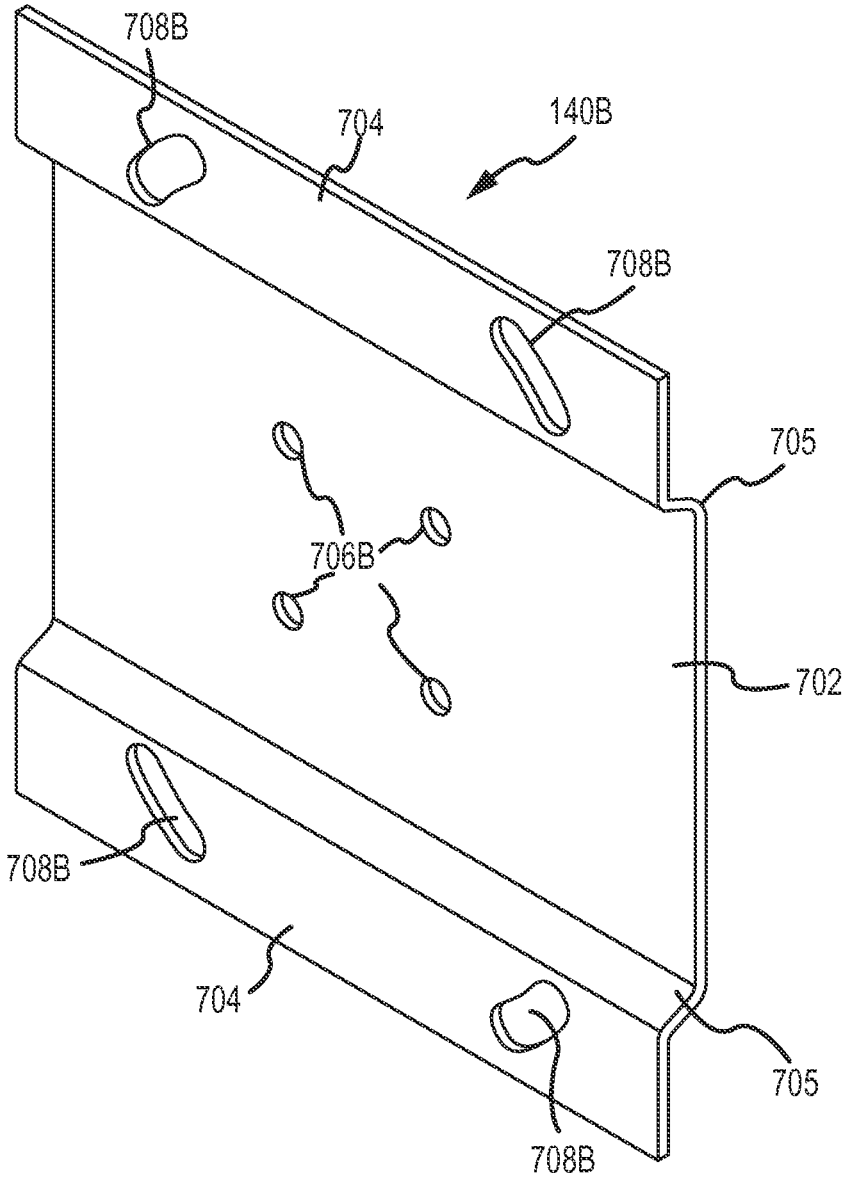
FIG. 7B is a perspective view of a second configuration of a third plate of an antenna mount according to an embodiment.

FIGS. 7A and 7B provide perspective views of different implementations of another component of an antenna mount: the third plate 140 of FIGS. 1 and 2, which is to be attached to the plate assembly 600 of FIG. 6A or 6B. In the specific example of FIG. 7A, the third plate 140A includes a planar section 702, and a mounting surface 704 coupled with the planar section 702. In the specific example shown in FIG. 7A, the mounting surface 704 includes two separate extension areas, one each at opposing ends of the planar section 702. Further, FIG. 7A depicts angled sections 705 coupling each portion of the mounting surface 704 with the planar section 702. This arrangement results in the mounting surface 704 extensions lying within a plane slightly removed from the plane of the planar section 702.

The mounting surface 704 defines a number of holes 708A for receiving bolts for attaching a mounting device of an antenna assembly thereto. An example of the mounting device (not shown in FIG. 7A) is discussed in greater detail below and is also depicted in FIG. 1 (mounting device 152) and described above in conjunction therewith. While the specific example of FIG. 7A displays four holes 708A, varying numbers of holes 708A or other openings may be included in other implementations. Also, similar to the holes 306 of the first plate 120, the holes 708A may include threads for receiving the mounting bolts. In another example, a threaded nut associated with each of the holes 708A may be integrated with the mounting surface 704 to receive the bolts. In another implementation, separate nuts, such as locking nuts, serrated hex head nuts, nuts integrated with lock washers, and so on, may be threaded onto the bolts to affix the mounting device to the third plate 140A.

The planar section 702 of the third plate 140A includes a number of openings 706A through which the bolts 202 extending from the plate assembly 400 of FIG. 4 may protrude. In the illustration of FIG. 7A, the openings 706A are curvilinear slots 706A oriented about a center of the planar section 702, thus allowing the third plate 140A to be skewed about of the planar section 702 in relation to the plate assembly 600 before being rigidly attached to the assembly 600. In one example, this skewing or rotation allows the third plate 140A to be oriented vertically when the plate assembly 600 is attached to a mounting base, such as a support post 102, that is not oriented in such a manner. In other embodiments, this skewing or rotation permits for adjusting skew of a dish antenna mounted to the third plate. Generally, the amount of skew allowed is determined at least in part by the length of each of the curvilinear slots 706A.

FIG. 7B provides a perspective view of a third plate 140B of an antenna mount—which is a component of at least one embodiment—that is in some aspects similar to the third plate 140A of FIG. 7A but provides various features that differ therefrom. The third plate 140B is to be attached to the plate assembly 600 of FIG. 6A or 6B. In the specific example of FIG. 7B, the third plate 140B includes a planar section 702 (i.e., a planar surface), and a mounting surface 704 coupled with the planar section 702. In the specific example shown in FIG. 7B, the mounting surface 704 includes two separate portions, one each at opposing ends of the planar section 702. The portions of mounting surface 704 are coplanar. Further, FIG. 7B depicts angled sections 705 coupling each portion of the mounting surface 704 with the planar section 702. This arrangement results in the mounting surface 704 portions lying within a plane slightly removed from the plane of the planar section 702, but parallel thereto. As depicted in FIGS. 7A and 7B, planar section 702 and mounting surface sections 704 may be of any number of varying widths and lengths, in order to accommodate design features of the antenna mount.

The mounting surface 704 of FIG. 7B defines a number of openings 708B for receiving bolts or other similar connecting devices for attaching a mounting device of an antenna and corresponding antenna thereto. In the illustration of FIG. 7B, the openings 708B are curvilinear slots oriented about a center point of the two portions of the mounting surface 704, thus allowing an attached antenna mounting device and corresponding antenna to be rotationally skewed in relation to the third plate 140B before being rigidly attached thereto. In one example, this skewing or rotation allows a mounting device of an antenna assembly to be oriented vertically when the plate assembly 140B is attached to a mounting base, such as a support post, that is not oriented in such a manner. Generally, the amount of skew allowed is determined at least in part by the length of each of the curvilinear slots 708B. While the specific example of FIG. 7B displays four slots 708B, varying numbers of openings may be included in other implementations. In at least one embodiment, separate nuts, such as locking nuts, serrated hex head nuts, nuts integrated with lock washers, and so on, along with zero or more corresponding washers, may be threaded onto the bolts to affix the mounting device to the third plate 140B once a desired orientation is obtained.

The planar section 702 of the third plate 140B includes a number of openings such as through holes 706B through which the bolts 202 or other attachment devices extending from the plate assembly 600 of FIG. 6A or 6B may protrude. Also, similar to the holes 306 of the first plate 120, the holes 706B may include threads for receiving the mounting bolts. In another example, a threaded nut associated with each of the holes 706B may be integrated with the planar surface 702 to receive the bolts. In at least one embodiment, separate nuts, such as locking nuts, serrated hex head nuts, nuts integrated with lock washers, and so on, along with zero or more corresponding washers may be threaded onto the bolts to affix the mounting device to the third plate 140B once a desired orientation is obtained.

Figure 8A:
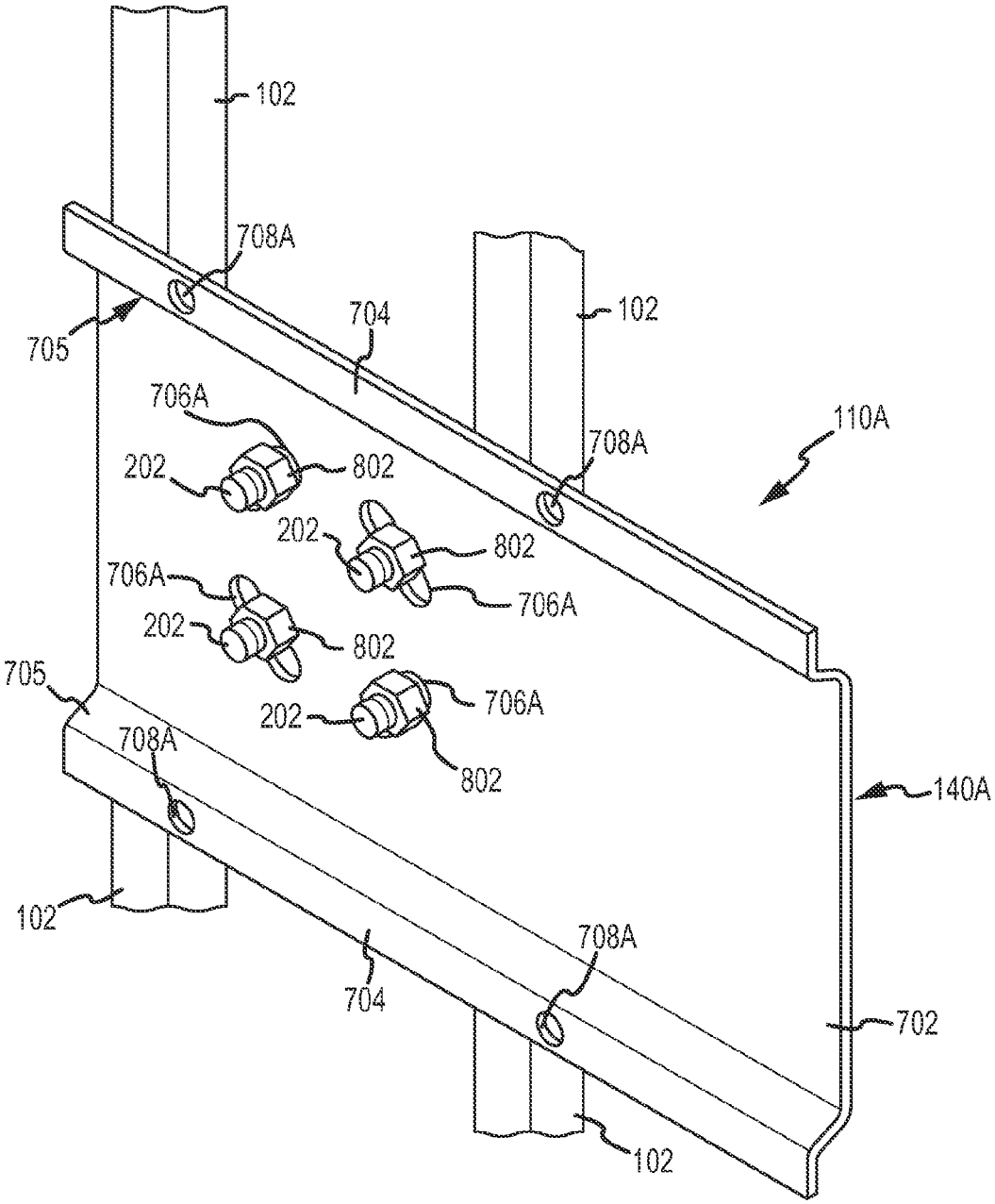
FIG. 8A is a perspective diagram of the third plate of FIG. 7A attached to the plate assembly of FIG. 4A according to an embodiment.

FIG. 8A provides a view of the third plate 140A of FIG. 7A securely affixed to the plate assembly 600 of FIG. 6A or 6B (obscured from view in FIG. 8A) by nuts 802 threaded onto the bolts 202 extending from the plate assembly 600, and subsequently tightened. The resulting structure comprises an antenna mount 110A, which may be an embodiment of the antenna mount 110 of the system depicted in FIG. 1. (As used herein, "antenna mount 110" may signify either antenna mount 110A or 110B or any embodiment or variation thereof.) By attaching the third plate 140A to the plate assembly 600 in this manner, the third plate 140A and the plate assembly 600 essentially clamp the support posts 102 therebetween, forming a stable connection between the antenna mount 110A and the posts 102. Ordinarily, the nuts 802 initially will be threaded loosely onto the bolts 202, the third plate 140A will be rotated into the desired orientation in the slots 706A, and then the nuts 802 will be tightened to maintain the selected orientation for the third plate 140A.

Figure 8B:
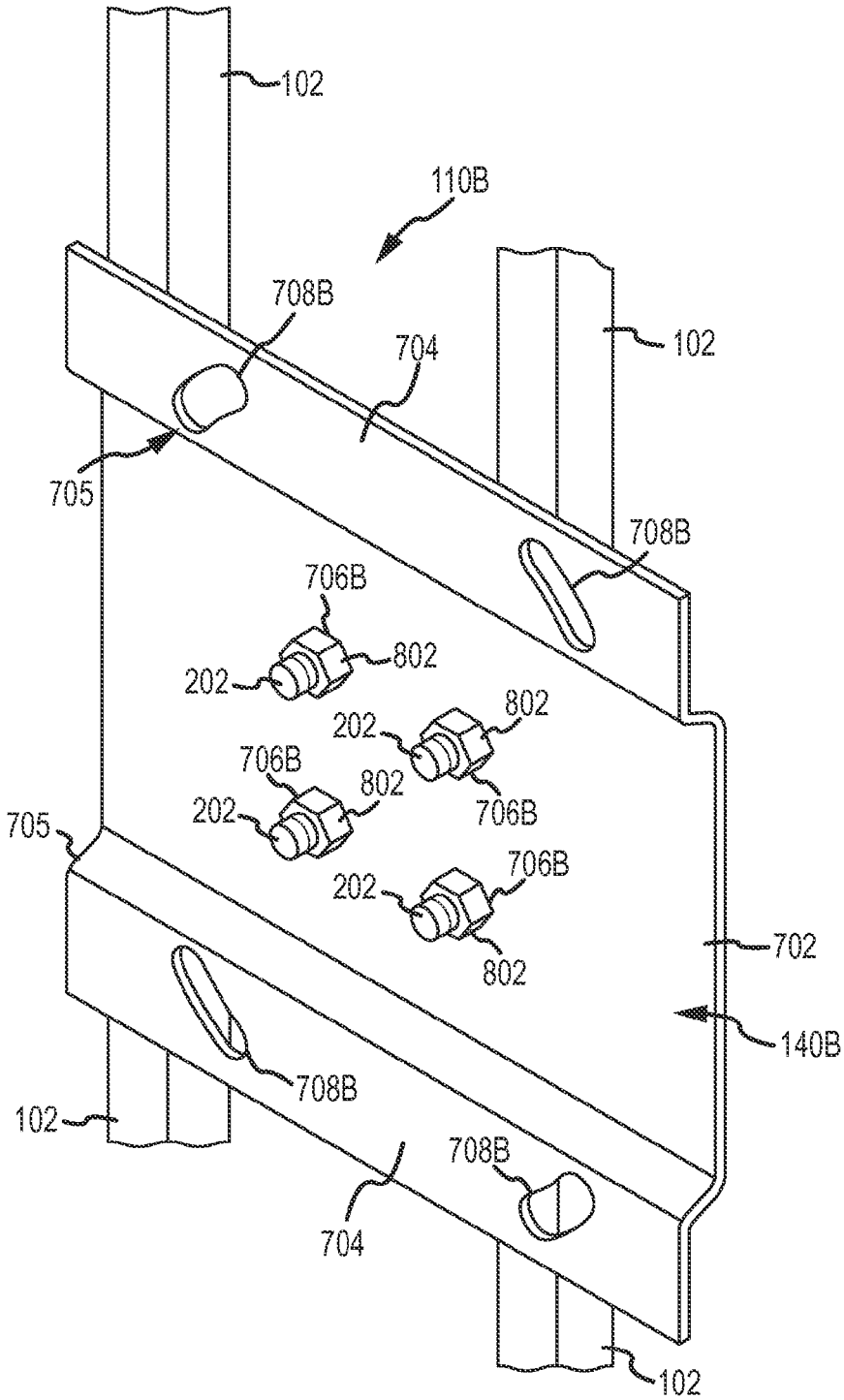
FIG. 8B is a perspective diagram of the third plate of FIG. 7B attached to the plate assembly of FIG. 4B according to an embodiment.

FIG. 8B depicts an alternative configuration for an antenna mount 110B that may have some similar features to the antenna mount 110B of FIG. 6, and which may be an implementation of antenna mount 110 depicted in FIG. 1. Antenna mount 110B includes the third plate 140B depicted in FIG. 7B and described above. In FIG. 8B, the third plate 140B is securely fixed to a plate assembly 600 (obscured from view in FIG. 8B) by nuts 802 threaded onto the bolts 202 extending from the plate assembly 600 through holes 706B, and subsequently tightened. The resulting structure comprises an antenna mount 110B. Similarly to antenna mount 110A of the previous paragraph, the third plate 140B and plate assembly 600 are secured such that support posts 102 are clamped therebetween, forming a stable connection between the antenna mount 110B and posts 102. The third plate 140B of antenna mount 110E may have holes 706B rather than the slots 706A depicted in FIG. 8A. With the antenna mount 110B, an attached antenna mounting device may be rotated in slots 708B to obtain a desired rotational orientation and/or skew.

As with the formation of the plate assembly 600, the third plate 140A or 140B may be affixed to the plate assembly 600, by means other than bolts and nuts, such as screws, clips, clamps, and the like, while remaining with the scope herein. With an antenna mount 110 firmly attached to the posts 102 (or other mounting base), hardware necessary for mounting an antenna assembly to the antenna mount 110 may be attached thereto.

Figure 9A:
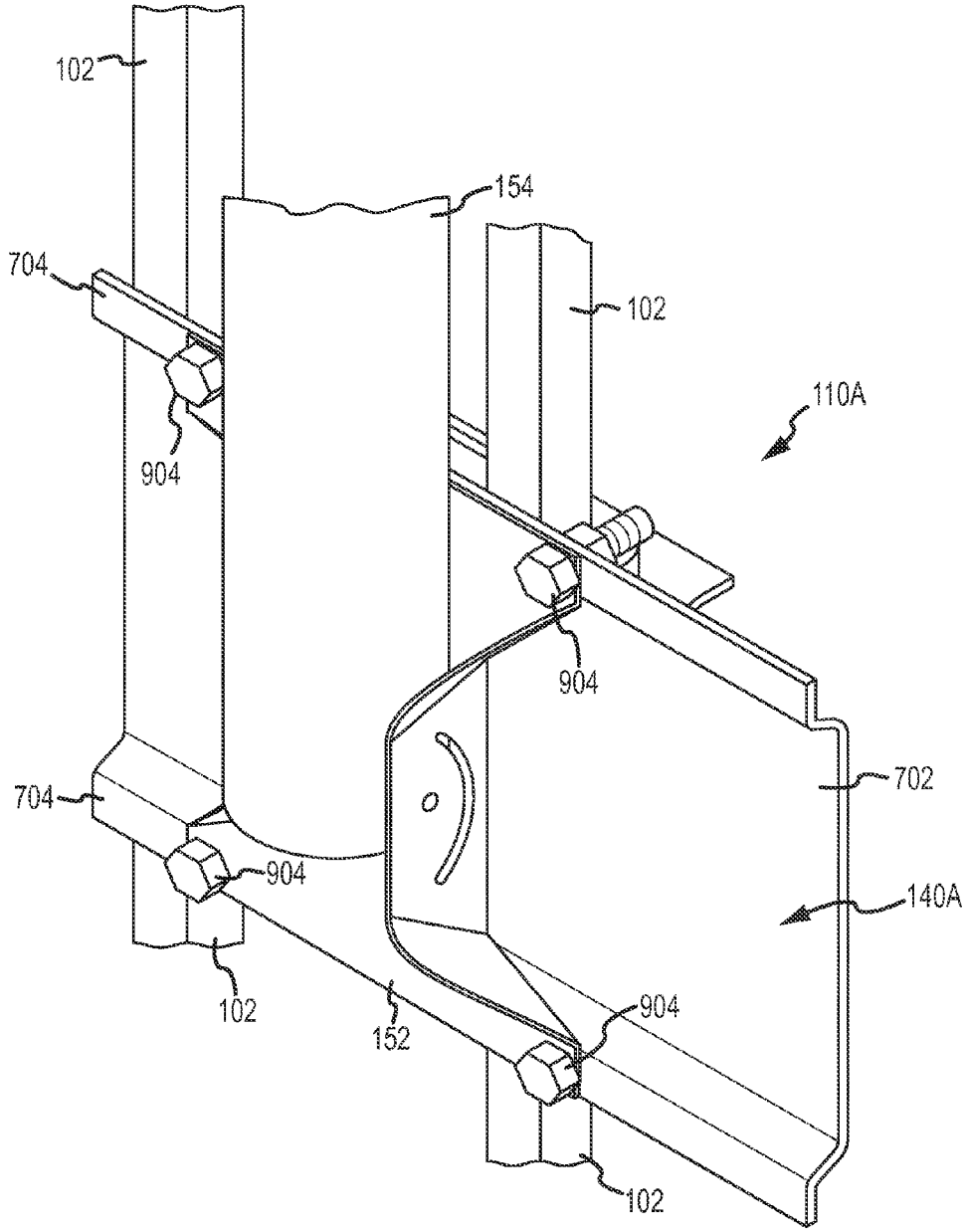
FIG. 9A is a perspective diagram of an antenna mast according to an embodiment, wherein a foot of the antenna mast is affixed to the third plate of FIG. 7A.

FIG. 9A illustrates an example of an antenna mast 154, which is also depicted in the system of FIG. 1, which has a foot section 152 configured to attach to the mounting surface 704 of the third plate 140A. In this example, the mast 154 is oriented vertically for attachment with a dish antenna, such as what may be used in conjunction with a satellite broadcast television receiver. In other embodiments, other types of mounting devices or hardware adapted specifically for a particular type of antenna, such as a satellite broadcast television or radio receiver antenna, a terrestrial (over-the-air) broadcast television or radio receiver antenna, a two-way radio communication antenna, and so on, may be employed to attach such an antenna with the mounting surface 704. Such devices may or may not incorporate a foot or mast, and may include other structures for appropriately mounting the antenna of choice for a particular application.

In FIG. 9A, bolts 904 are threaded through or into the holes 708A (obscured from view in FIG. 9A) of the mounting surface 704 of the third plate 140A to securely attach the foot 152, and thus the antenna mast 154, to the antenna mount 110A. If the holes 708A are threaded, or correspond with integrated nuts or similar structures, the bolts 904 may be tightened to affix the foot 152 to the mounting surface 704. In the case the holes 708A are not threaded, or do not have integrated nuts associated therewith; conventional nuts (not shown in FIG. 7) may be threaded onto the bolts 904 and tightened. Also, other means of attaching the foot 152 of the mast 154 to the third plate 140A, such as screws, clips, clamps, and other fasteners or attachment devices, may be utilized in other implementations.

Figure 9B:
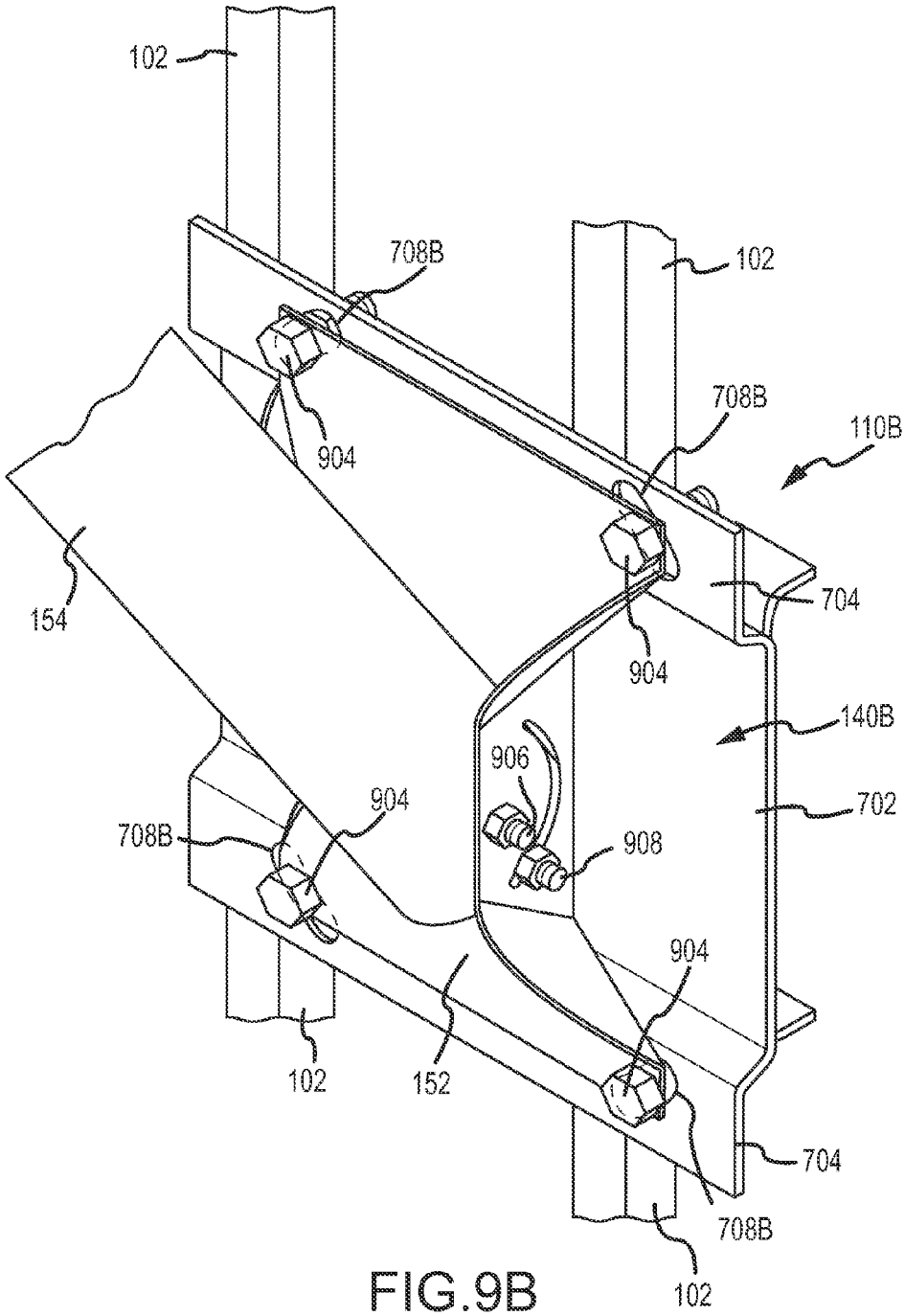
FIG. 9B is a perspective diagram of an antenna mast according to an embodiment, wherein a foot of the antenna mast is affixed to the third plate of FIG. 7B.

FIG. 9B illustrates a second embodiment of an antenna mast 154 attached to an antenna mount 110B that is affixed to support posts of a rail. In FIG. 9B, mast 154 is coupled to a foot section 152 configured to attach to the mounting surface 704 of the third plate 140B. In this example, the mast 154 may be oriented at an angle away from the rails, as depicted in FIG. 9B, to provide a mount for a dish antenna as depicted in the system of FIG. 1. In the specific example of FIG. 9B, mast 154 is attached to foot section 152 with a bolt 906 and corresponding nut, or other connector, such as a rod, pin, or so forth, which provides a fixed line of rotation around which the mast 154 may be rotated. The mast 154 is further attached to foot section 152 with a second bolt 908 or other connector disposed in a curvilinear slot in the foot section. This allows for the angle of the mast 154 with respect to the foot 152 and third plate 140B to be adjustable. The second bolt 908 may be coupled to a nut, which may be tightened to securely set a desired angle of the mast 154. In at least one embodiment, however, an antenna mast may be affixed to an antenna mount at a predetermined, non-adjustable angle.

In FIG. 9B, bolts 904 are disposed through the slots 708B of the mounting surface 704 of the third plate 140B and threaded through corresponding nuts (obscured from view) to securely attach the foot section 152, and thus the antenna mast 154, to the assembled antenna mount 110B. Ordinarily, the bolts 904 may initially be threaded loosely into corresponding nuts, such that the foot section 152 may be rotated in the curvilinear slots 708B into a desired orientation, and then the corresponding nuts will be tightened to maintain the selected orientation for the foot section 152 and the corresponding mast 154. Rotation within slots 708B allows the mast 154 to be mounted perpendicularly to the horizon, or at another angle or degree of skew, even if the support posts 102 are not oriented similarly.

In one embodiment, the components discussed above constituting the antenna mount 110 (i.e., the first plate 120, the second plate 130, and the third plate 140) may be provided as a kit to be assembled by a purchaser or installer. In one example, the kit may also contain the various attachment devices, such as bolts, nuts, screws, clips, clamps, or the like, to attach the various plates 120, 130, 140 together as described above.

Figure 10:
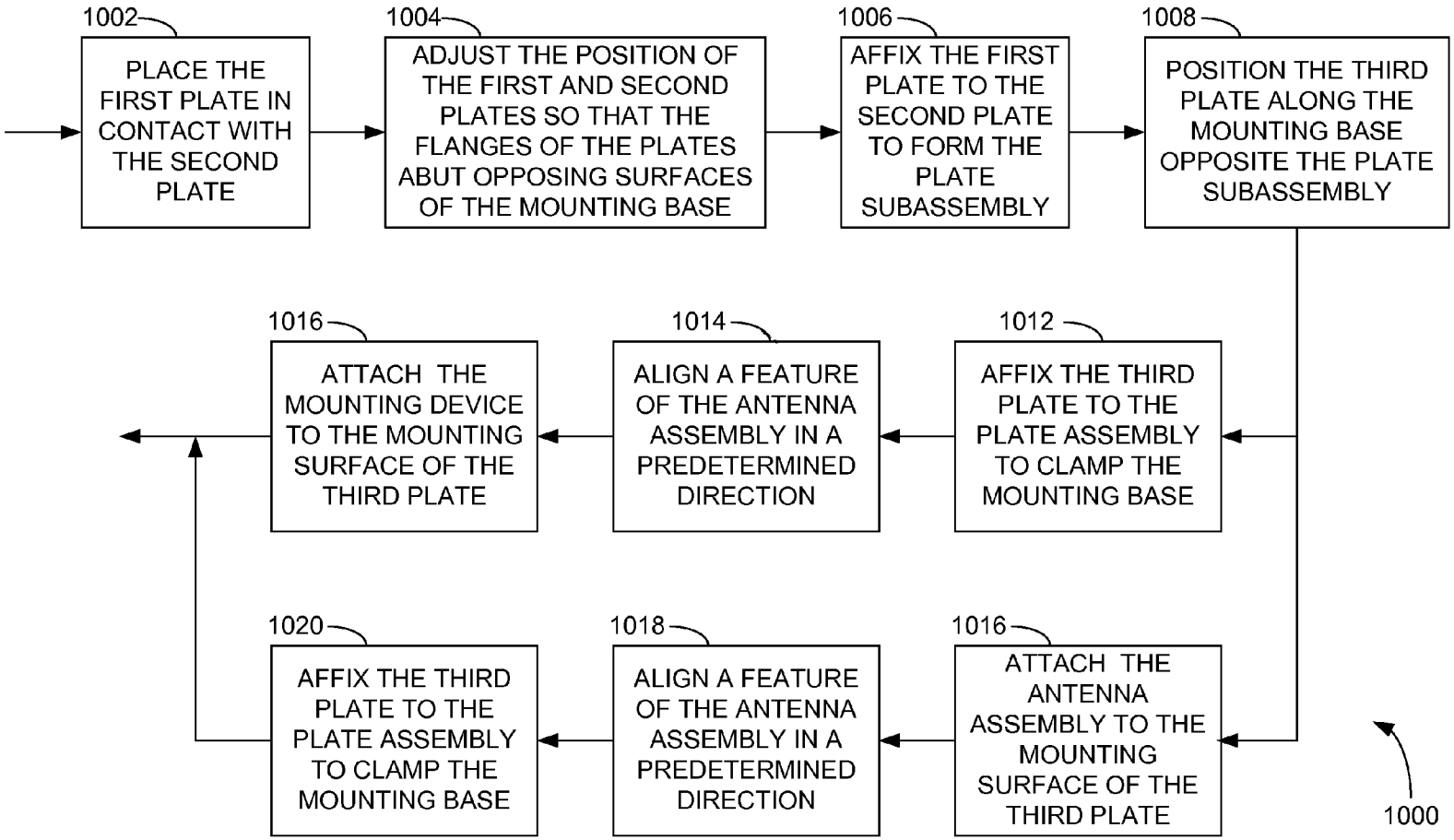
FIG. 10 is a flow diagram of a method of mounting an antenna.

FIG. 10 presents a flow diagram of a method 1000 for assembling the various pieces of a kit as described above to form a functioning antenna mount 110 according to an embodiment. At least some of the operations of FIG. 10 are described in some detail above. First, the first plate 120 is placed in contact with the second plate 130 (operation 1002). The plates 120, 130 are positioned such that the planar section 302 of the first plate 120 and the surface 402A or 402B of the second plate 130 are parallel to each other, and the flange 304 and flange 404A or members 404B of the plates 120, 130 are parallel to each other and extend in the same direction, as indicated in FIGS. 5, 6A, and 6B. In one example, bolts 202 may be installed through the openings 306, 406 of the first and second plates 120, 130 to maintain somewhat the orientation of the plates 120, 130.

The relative position of the first plate 120 and the second plate 130 is then adjusted so that the flange 304 and flange 404A or members 404B abut opposing surfaces of a mounting base (operation 1004). In the specific example of FIGS. 6A & 6B, the opposing surfaces are sides of the support posts 102 described above, although other mounting bases may be employed to similar end. The first plate 120 is then securely affixed to the second plate 130 to form the plate assembly 600 (operation 1006). Typically, this operation occurs while the first plate 120 and the second plate 130 are abutted against the posts 102 or other mounting base, thus potentially allowing the posts 102 to retain the plate assembly 600.

The third plate 140 is then positioned along the mounting base (e.g., the support posts 102) opposite the plate assembly 600 (operation 1008). The planar section 702 of the third plate 140 is thus parallel to the planar section 302 of the first plate 120 and planar section 402A or surface 402B of the second plate 130.

At this point, the third plate 140 is attachable to the plate assembly 600 to form an antenna mount 110. To ensure proper alignment of the antenna assembly, at least two different approaches may be followed.

In a first example, the third plate 140 is securely affixed to the plate assembly 600 to clamp the resulting antenna mount 110 to the posts 102 or other mounting base (operation 1012), as shown in FIGS. 8A and 8*b*. Optionally, prior to securely affixing the third plate 140 to the plate assembly 600, a feature of the third plate 140, such as an edge of the third plate 140, may be aligned in a predetermined direction, such as a vertical or horizontal direction, such as by the use of a level or similar tool. In an embodiment corresponding to FIGS. 8B and 9B, a mounting device (e.g., foot plate 152) of an antenna assembly may be loosely attached to the third plate 140B. In this example, the mounting device may be rotated according to slots 708B such that a feature of the antenna assembly is aligned in a predetermined direction (operation 1014). The antenna mounting device, may then be securely attached to the mounting surface 704 of the third plate 140 (operation 1014), as illustrated in FIGS. 9A and 9B.

In another embodiment, which corresponds the embodiments depicted in FIGS. 8A and 9A, after the third plate 140A has been positioned along the mounting base opposite the plate assembly 600, and attached loosely thereto with the bolts 202 or other attachment devices, the mounting device of the antenna assembly (e.g., the foot plate 152) may be attached to the mounting surface 704 of the third plate 140A (operation 1016). A feature of antenna assembly, such as a surface of the mast 154, may then be aligned in a predetermined direction, such as a vertical or horizontal direction (operation 1018). As the antenna is thus aligned, rotation of the third plate 140A with respect to the plate assembly 600 may be facilitated by the bolts 202 rotating in the curvilinear slots 706A. Once this alignment is complete, the third plate 140A may be securely affixed to the plate assembly 600 to clamp the posts 102 therebetween (operation 1020). In various applications, other methods for assembling the antenna mount 110A and/or 110B and attaching a mounting device and antenna thereto may also be possible.

Various embodiments as described herein may provide a number of benefits. Generally, the antenna mount as disclosed herein allows the secure and stable installation of an antenna, such as a DBS dish antenna, to a railing or other potential mounting base without imposing damage, such as drilled holes, normally resulting from mounting an antenna. This particular benefit provides potential communication service subscribers in multi-dwelling units, such as apartments, condominiums, and the like, the ability to secure a satellite antenna or similar device without running afoul of community rules. Similarly, other users may employ the antenna mount and methods described herein to provide a stable platform for their antenna or other equipment without inflicting damage on their own property. It is to be understood that although dish antenna is depicted herein as an example, the antenna mounts, kits, and methods described herein may also be used to mount other types of non-dish antennas.

While several embodiments have been discussed herein, other embodiments encompassed by the scope herein are possible. For example, while various embodiments have been described primarily within the context of satellite, cable, and terrestrial antenna systems and similar equipment, any object requiring a stable platform, including signage, lighting, and so on, may benefit from the implementation of the principles described herein, with respect to both outdoor and indoor applications. In addition, aspects of one embodiment disclosed herein may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims and their equivalents.

What is claimed is:

1. An antenna mount, comprising:

a first plate comprising a planar surface, a plurality of openings in the planar surface for receiving a plurality of attachment devices, and a flange disposed transversely to the planar surface;

a second plate secured to the first plate with the attachment devices to form a plate assembly, the second plate comprising a surface that is disposed parallel to and in contact with the planar surface of the first plate, a plurality of elongated openings, disposed longitudinally on the surface, which receive the attachment devices, a stiffening structure disposed transversely to the surface at one end of the surface, the one or more members parallel to the flange of the first plate and extending in the same direction as the flange of the first plate, wherein the flange of the first plate and the one or more members of the second plate are configured to abut oppositely facing surfaces of a mounting base;

a third plate comprising a planar surface with a plurality of openings that receive the attachment devices, and a mounting surface, the mounting surface including two coplanar portions that are each attached at opposing ends of the planar surface of the third plate, wherein a plane of the two portions of the mounting surface is parallel to and slightly removed from a plane of the planar surface of the third plate, the mounting surface having a plurality of openings that are configured to receive a plurality of connecting devices to secure a mounting device of an antenna assembly to the third plate, wherein the planar surface of the third plate is positioned to abut a surface of the mounting base that is opposite a surface of the mounting base that is abutted by the plate assembly, and the third plate is affixed to the plate assembly such that the mounting base is clamped between the third plate and the plate assembly.

2. The antenna mount of claim 1, wherein the stiffening structure of the second plate comprises an elongated corrugation that is defined by the surface of the second plate and that is parallel to the elongated openings of the second plate.

3. The antenna mount of claim 1, wherein:

the plurality of attachment devices comprises a plurality of bolts and a plurality of nuts;

the planar section of the first plate defines a plurality of threaded holes;

each of the plurality of bolts extends through one of the elongated openings of the second plate and is threaded into one of the threaded holes of the first plate to secure the first plate to the second plate;

each of the plurality of bolds extends through one of the plurality of openings defined by the planar surface of the third plate; and each of the plurality of nuts is threaded onto a corresponding one of the bolts to secure the third plate to clamp the mounting base between the third plate and the plate structure.

4. The antenna mount of claim 1, further comprising:

the mounting device for the antenna, wherein the mounting device is rigidly attached to the mounting surface of the third plate with the plurality of connecting devices.

5. The antenna mount of claim 4, wherein:

the mounting device comprises a mast for the antenna; and the mast comprises a foot attached to the mounting surface of the third plate.

6. The antenna mount of claim 4, wherein the plurality of connecting devices comprise a plurality of bolts and a plurality of nuts, the plurality of openings in the mounting surface of the third plate comprise slots, which are configured such that the mounting device of the antenna may be rotationally skewed to configure an alignment of the antenna prior to the mounting device being securely attached to the third plate, and the mounting device of the antenna is securely attached to the mounting surface of the third plate with the plurality of bolts and nuts once a desired alignment of the antenna is achieved.

7. An antenna mount, comprising:

a first plate comprising a planar section and a flange connected to the planar section;

a second plate comprising a surface, a first member connected to the surface, and a corrugation disposed in the surface; and a third plate comprising a planar section and a mounting surface connected to the planar section, wherein the mounting surface is configured to connect to a mounting device of an antenna;

wherein the first plate is configured to be attached to the second plate to form a plate structure such that the planar section of the first plate contacts the surface of the second plate, the flange of the first plate is parallel to the first member of the second plate and extends in the same direction as the first member, and a distance between the flange and the first member is adjustable to allow the flange and the first member to abut opposing surfaces of a mounting base; and wherein the third plate is configured to be attached to the plate structure to clamp the mounting base therebetween.

8. The antenna mount of claim 7, wherein the first member is disposed on a first edge of the surface of the second plate, the second plate further comprising a second member on the first edge that is coplanar to the first member, spaced at a distance from the first member, and oriented in the same direction as the first member.

9. The antenna mount of claim 7, further comprising:

an attachment device configured to attach the first plate to the second plate to form the plate structure.

10. The antenna mount of claim 9, wherein:

the attachment device is configured to attach the third plate to the plate structure.

11. The antenna mount of claim 9, wherein:

the attachment device comprises a plurality of bolts;

the planar section of the first plate defines a plurality of threaded through holes;

the planar section of the second plate defines a plurality of elongated slots;

each of the plurality of bolts is configured to extend through one of the elongated slots of the second plate and be threaded into one of the threaded through holes of the first plate to secure the first plate to the second plate; and the elongated slots are configured to allow the distance between the flange of the first plate and the first member of the second plate to be adjusted to abut opposing surfaces of a mounting base before the first plate is secured to the second plate to form the plate structure.

12. The antenna mount of claim 11, wherein:

the attachment device further comprises a plurality of nuts, the planar section of the third plate defines a plurality of openings, the plurality of openings being aligned such that corresponding ones of the plurality of bolts pass therethrough; and each of the plurality of nuts is configured to be threaded onto a corresponding one of the bolts to secure the third plate to the plate structure and clamp the mounting base between the third plate and the plate structure.

13. The antenna mount of claim 7, wherein:

the mounting surface of the third plate comprises first and second extensions coupled to opposing edges of the planar section of the third plate; and the first and second extensions are coplanar, and are on a plane that is removed from and parallel to a plane of the planar section of the third plate.

14. The antenna mount of claim 13, wherein:

the mounting surface defines a plurality of openings configured to receive a plurality of connecting devices for connecting the mounting device of the antenna to the mounting device.

15. The antenna mount of claim 14, wherein:

the connecting devices comprise a plurality of bolts and a plurality of nuts; and the openings on the mounting surface of the third plate comprise a plurality of slots, which are configured to allow the mounting device for the antenna to be rotationally skewed in relation to the third plate.

16. The antenna mount of claim 7, wherein:

the mounting base comprises support posts of a railing, wherein the flange of the first plate and the first member of the second plate are configured to abut opposite sides of separate ones of the support posts.

17. A rail mounted antenna system, comprising:

an antenna mount, comprising a first plate comprising a planar surface, a plurality of openings in the planar surface for receiving a plurality of attachment devices, and a flange disposed transversely to the planar surface;

a second plate secured to the first plate with the attachment devices to form a plate assembly, the second plate comprising a surface that is disposed parallel to and in contract with the planar surface of the first plate, a plurality of elongated openings disposed longitudinally on the surface, which receive the attachment devices, a stiffening structure disposed longitudinally on the surface, and one or more members disposed transversely to the surface at one end of the surface, the one or more members parallel to the flange of the first plate and extending in the same direction as the flange of the first plate and extending in the same direction as the flange of the first plate, wherein the flange of the first plate and the one or more members of the second plate are configured to abut oppositely facing surfaces of a mounting base;

a third plate comprising a first planar surface with a plurality of openings that receive the attachment devices, and a mounting surface, the mounting surface including two coplanar portions that are each attached at opposing ends of the planar surface, wherein a plane of the two portions of the mounting surface is parallel to and slightly removed from a plane of the planar surface of the third plate, the mounting surface having a plurality of openings that are configured to receive a plurality of connecting devices to secure a mounting device of an antenna assembly to the third plate;

wherein the planar surface of the third plate is positioned to abut a surface of the mounting base opposite a surface of the mounting base that is abutted by the plate assembly, and the third plate is affixed to the plate assembly such that the mounting base is clamped between the third plate and the plate assembly; and an antenna, comprising an antenna mast, coupled to the mounting device, which is secured to the mounting surface of the third plate with the plurality of connecting devices; and a signal receiving device, coupled to the antenna mast, which receives communication signals.

18. The rail mounted antenna system of claim 17, wherein the stiffening structure of the second plate comprises an elongated corrugation that is defined by the surface of the second plate, and the plurality of connecting devices to secure the mounting device of the antenna assembly to the third plate comprise a plurality of bolts and a plurality of nuts.

19. The rail mounted antenna system of claim 17, the antenna assembly further comprising:

a reflector attached to the antenna mast;

a feedhorn arm attached to the reflector, wherein the signal receiving device is connected to the feedhorn arm such that the communication signals are reflected by the reflector into the signal receiving device.

20. The rail mounted antenna system of claim 19, wherein the antenna structure is configured to receive satellite communication signals.

* * * * *